United States Patent [19]

Stoll

[11] Patent Number: 5,013,020

[45] Date of Patent: May 7, 1991

[54] APPARATUS TO GUIDE COPY SEGMENTS IN THE FOLDER OF ROTARY PRINTING PRESSES

[75] Inventor: Norbert Stoll, Beindersheim, Fed. Rep. of Germany

[73] Assignee: Heidelberger Druckmaschinen AG, Heidelberg, Fed. Rep. of Germany

[21] Appl. No.: 383,603

[22] Filed: Jul. 20, 1989

[30] Foreign Application Priority Data

Jul. 20, 1988 [DE] Fed. Rep. of Germany ... 8809285[U]

[51] Int. Cl.[5] ..... B42C 1/00

[52] U.S. Cl. ..... 270/49; 270/47; 270/13

[58] Field of Search ..... 270/21.1, 40, 45, 47-51, 270/60, 13

[56] References Cited

U.S. PATENT DOCUMENTS

| | | | |
|---|---|---|---|
| 4,279,410 | 7/1981 | Bolza-Schunemann | 270/50 |
| 4,648,586 | 3/1987 | Michalik | 270/50 |
| 4,817,932 | 4/1989 | Stab | 270/47 |
| 4,893,803 | 1/1990 | Petersen | 270/47 |

FOREIGN PATENT DOCUMENTS

| | | | |
|---|---|---|---|
| 3126279 | 1/1983 | Fed. Rep. of Germany | 270/21.1 |
| 3534157 | 4/1987 | Fed. Rep. of Germany | 270/60 |
| 55-93771 | 7/1980 | Japan | 270/60 |

*Primary Examiner*—Edward K. Look
*Assistant Examiner*—Therese M. Newholm
*Attorney, Agent, or Firm*—Nils H. Ljungman & Associates

[57] ABSTRACT

Folding apparatus for a printing press which employs a moving conveyor belt in conjunction with a rotating folding flap cylinder to fold and move a copy segment through the printing press. Suction apparatus is provided to remove the copy segment from a folding blade cylinder so that it may be directed to the folding apparatus.

16 Claims, 2 Drawing Sheets

APPARATUS TO GUIDE COPY SEGMENTS IN THE FOLDER OF ROTARY PRINTING PRESSES

FIELD OF THE INVENTION

This invention relates to an apparatus to guide copy segments in the folder of rotary printing presses between the folding blade and folding flap cylinders with guide means for the forward half of the copy on the folding blade cylinder, to prevent the formation of corners by the folding blade.

DESCRIPTION OF THE PRIOR ART

It is known to provide a suction roller between the folding blade cylinder and the folding flap cylinder, on the delivery side, which is in contact on both sides with guide plates. If the copy segment is pushed by the folding blade into and seized by the folding flap, then the forward half of the copy is released by the puncture needles of the folding blade cylinder. As the folding flap cylinder continues to turn, the forward half of the copy is extracted by the jacket of the folding blade cylinder opposite to the previous direction of movement. The forward half of the copy tends to flutter, because of the reversal of the direction of movement and because of the extraction at a high velocity resulting in damage or bent corners.

The prior art attempts to eliminate these disadvantages by activating the suction roller during retraction and simultaneously deflecting the forward half of the copy. The suction, however, occurs very late, while the major part of the forward half of the copy can move freely between the jacket of the folding blade cylinder and the guide plate. That does not prevent damage. After the suction holes of the suction roller are covered on top by the copy, no suction action can be exerted even in the immediate vicinity of the guide plates. Moreover, there is a gap between the suction roller and the guide plates, which allows the suction to be broken, so that the suction effect cannot occur in the gap. Therefore, when there is a reversal of the direction of movement of the forward half of the copy, fluttering and damaged or bent corners can occur. Another disadvantage is that the suction roller, when it picks up the folded copy, must be driven by the latter, so that, for example, when working with thin papers and sensitive printed matter, damage can also occur to the folded copies.

OBJECT OF THE INVENTION

One object of the invention is to guarantee a secure guidance and deflection of the copy and to grasp the forward copy half early when it is being extracted from the folding blade cylinder, to prevent damage and bent corners.

SUMMARY OF THE INVENTION

This present invention provides a belt roller with conveyor belts, in the delivery gap between the folding blade and folding flap cylinder, whose delivery sides are in contact with the jacket surface of the folding flap cylinder. A suction chamber is fastened between the side frames of the press following the belt roller, at a slight distance from the jacket of the folding blade cylinder. The belt roller and the suction chamber extend over the length of the cylinder. The advantage of this arrangement is that the belt roller precisely deflects the front copy half during extraction, the belt roller is constantly driven by the belt and, as a result of the suction chamber, there is an early pick-up of the folded copy so that it is precisely guided, without the danger of damage or bent corners. Here, a relatively low suction is sufficient to guarantee a secure guidance of the copy half so that there is also no risk that there will be any damage to the printed image.

In one embodiment of the invention, the suction plate is located on a guide plate and has suction openings over the length of the suction chamber for the forward half of the copy. This makes possible a full-surface attachment of the forward copy half, so that the guidance is further improved. In another embodiment of the invention, the suction chamber is divided along its length into segments by partitions and each segment is equipped separately with adjustment apparatus for the suction. In this embodiment, a portion of the suction chamber can be closed off, for example when working with narrow copies, to provide less suction force. The suction force can also be individually adjusted across the width of the copy, as a function of the particular requirements.

One aspect of the invention resides broadly in an apparatus for guiding and moving a copy segment through a portion of the folding apparatus of a rotary printing press. The rotary printing press includes a rotatable folding blade cylinder which defines a longitudinal dimension and a rotatable folding flap cylinder having a generally cylindrical exterior surface which includes a movable conveyor belt which is relatively positioned with respect to the folding flap cylinder. At least a portion of the movable conveyor belt moves in conjunction with and bears upon at least a portion of the exterior surface of the folding flap cylinder. The folding blade cylinder and the folding flap cylinder are relatively positioned to guide and move the copy segment to between the movable conveyor belt device and the folding flap cylinder by the rotation of the folding blade cylinder and the folding flap cylinder. The movable conveyor belt device in conjunction with the folding flap cylinder further moves and guides the copy segment through a portion of the folding apparatus. A folding device folds the copy segment by making a crease in a portion thereof.

BRIEF DESCRIPTION OF THE DRAWINGS

The following Detailed Description of the Preferred Embodiments may be better understood when taken in conjunction with the appended drawings in which.

DESCRIPTION OF THE PREFERRED EMBODIMENTS

Figure 1:
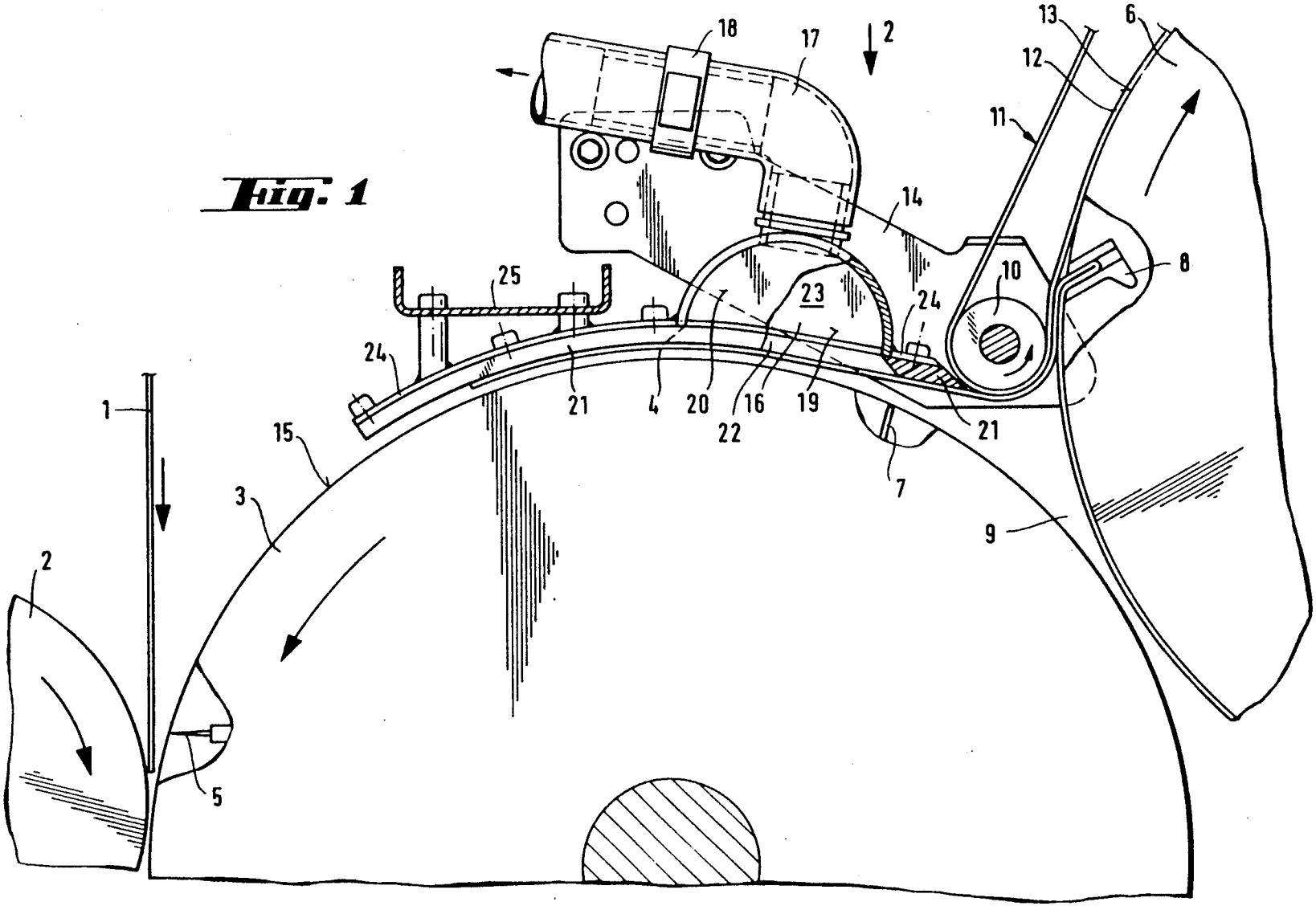
FIG. 1 is a side elevational view of the present invention.
Figure 2:
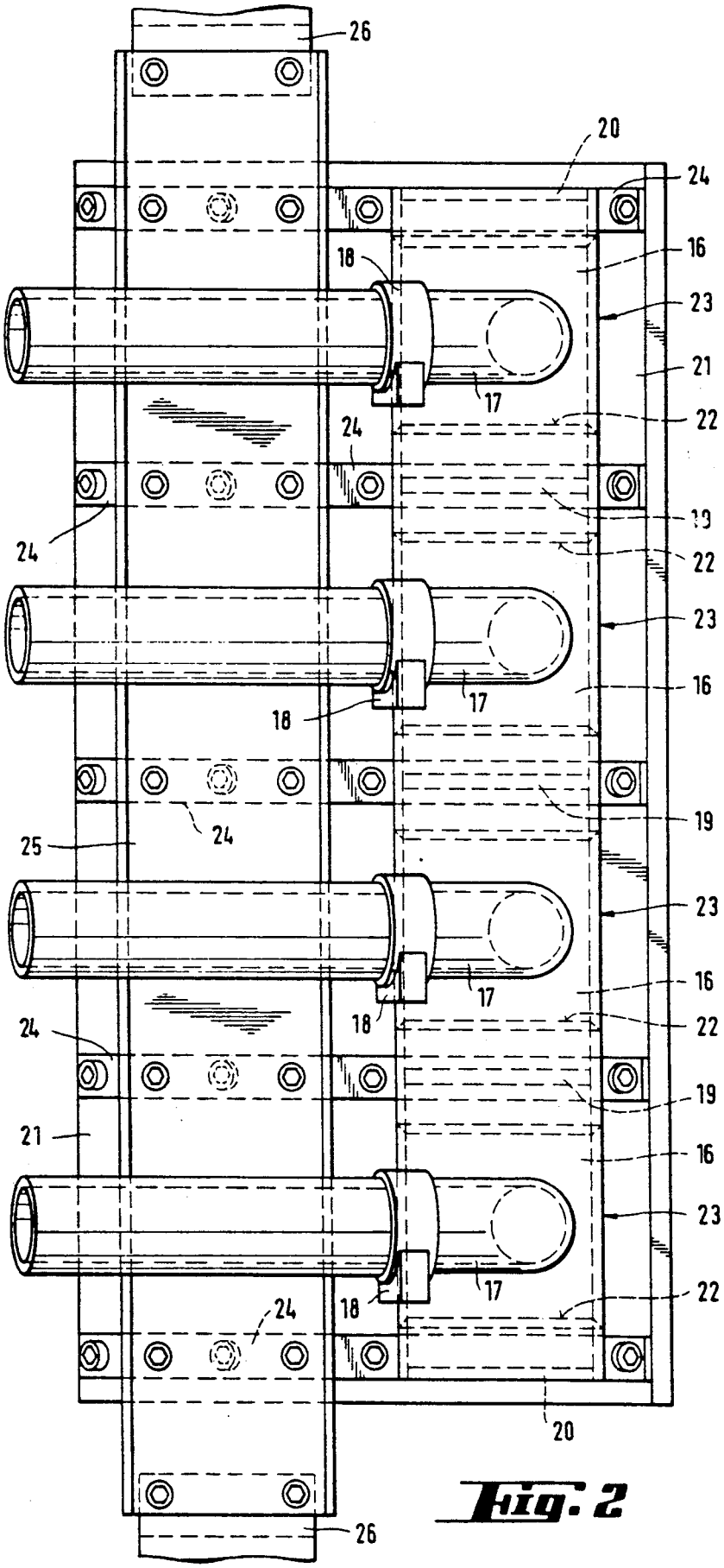
FIG. 2 is a top view of the present invention.

Paper web 1, is cut into individual copy segments between blade cylinder 2 and folding blade cylinder 3. The beginning of the copy segment is then seized by puncture needles 5 and is transported forward by folding blade cylinder 3 in its direction of rotation. In the median line between folding blade cylinder 3 and folding flap cylinder 6, the center of the separated copy segment is pushed by folding blade 7, between folding flaps 8, so that, after the closing of folding flaps 8, the first cross fold is formed. Folding flaps 8 then move the copy segment in the direction of rotation of folding flap cylinder 6.

Belt roller 10 is positioned in delivery gap 9 between folding blade cylinder 3 and folding flap cylinder 6, and guides conveyor belts 11. Delivery sides 12 are in contact with jacket 13 of folding flap cylinder 6. Belt roller 10 is mounted on both sides in bearing plates which, in turn, are fastened inside the side frames.

Belt roller 10 is followed, at a short distance from jacket 15 of folding blade cylinder 3, by suction chamber 16, which is partially evacuated by suction lines 17. Suction chamber 16 exerts a braking force on the front of the copy segment. The underpressure in suction lines 17 can be controlled or cut off by valve 18. Suction chamber 16 is divided into individual segments 23 by partitions 19, with one suction line 17 corresponding to each segment. The underpressure can be adjusted for each individual segment and, for narrow paper, may be disconnected for individual segments. Suction chamber 16 is closed on its ends by covers 20 and, like the belt roller, is preferably as wide as the maximum width of the sheets to be processed.

In the illustrated embodiment, suction chamber 16 is fastened to a guide plate, which has suction openings 22 over the length of suction chamber 16. Suction openings 22 correspond to the segments 23 of the suction chamber 16. If no guide plate 21 is employed, then the opening of suction chamber 16 can be covered by webs.

Guide plate 21 is, preferably, made of an ink-repellent plastic material and is held in position by belts 24. Belts 24, with suction chamber 16 and suction lines 17, in turn, are fastened to support rail 25, which is adjustably mounted on bearings 26 in the press side frames.

Forward copy half 4 is sucked against guide plate 21 by the underpressure in suction chamber 16, after it is released by the puncture needles 5, so that fluttering of the copy segments and bending are prevented. As a result of the rotational movement of folding flap cylinder 6, folding flap 8, in conjunction with conveyor belts 11, transports the copy segments further against the braking force of suction chamber 16, so that the front copy half is deflected by belt roller 10 and both copy halves lie on top of one another. Then the folded copy is discharged from the folding apparatus, or additional folds are made.

U.S. Pat. No. 4,666,139, entitled "Vacuum System for Combination Fold-Off Control", the contents of which are hereby expressly incorporated by reference, discloses an alternate embodiment which may be employed in conjunction with the present invention, and provides a detailed explanation of how folding machines, in general, operate.

Other examples of printing presses, folding apparatus, paper transport apparatus and conveyor belts may be found in: U.S. Pat. No. 3,986,711, entitled "Tucker Folder for Newspaper Rotary Printing Presses": U.S. Pat. No. 4,721,504, entitled "Apparatus and Method for Folding Cut Sheet Paper"; U.S. Pat. No. 4,588,393, entitled "Apparatus and Method for Folding Cut Sheet Paper"; U.S. Pat. No. 4,519,594, entitled "Former for a Folder in a Web-fed Rotary Printing Press": U.S. Pat. No. 4,391,596, entitled "Folder"; U.S. Pat. No. 4,279,410, entitled "Folder for a Web-fed Rotary Printing Press"; U.S. Pat. No. 4,187,968, entitled "Apparatus for Threading a Paper Web Into the Folding Mechanism of a Rotary Printing Press": U.S. Pat. No. 4,545,782, entitled "Anti-dog-ear Device for a Folding Apparatus"; U.S. Pat. No. 4,493,690, entitled "Cam Activated Anti-dog-ear Device"; U.S. Pat. No. 4,053,150, which relates to a folding blade or knife of a quarter folder apparatus: U.S. Pat. No. 4,725,051, entitled "Cutting Device in Folding Apparatus of a Rotary Printing Machine"; U.S. Pat. No. 4,565,359, entitled "Folding Apparatus for a Web-fed Rotary Printing Press": U.S. Pat. No. 4,559,032, entitled "Multi-sheet Rotary Folding Apparatus, Particularly for Association with Rotary Printing Machines"; U.S. Pat. No. 4,509,939, entitled "Folding Device for Web-fed Rotary Printing Presses"; U.S. Pat. No. 4,465,296, entitled "Printing Substrate Handling, Particularly Sheet Folding Apparatus": U.S. Pat. No. 4,143,870, entitled "Folder Delivery Arrangement for Reel-fed Rotary Printing for Presses"; U.S. Pat. No. 4,494,949, entitled "Sheet Folding Apparatus and Method"; and U.S. Pat. No. 4,598,641, entitled "Printing Cylinder Construction for Sheet-fed Offset Rotary Printing Machine". All of the above-mentioned patents are hereby expressly incorporated herein by reference as if the entirety thereof were fully set forth herein.

In summary, one aspect of the invention resides in an apparatus to guide copy segments in the folding apparatus of rotary printing presses between the folding blade and the folding flap cylinders with guide arrangements for the forward half of the copy on the folding blade cylinder, to prevent bent corners during extraction by the folding flap, characterized by the fact that in the delivery gap 9, between the folding blade cylinder 3 and the folding flap cylinder 6, there is a belt roller 10 with conveyor belts 11, whose delivery sides 12 are in contact with the jacket 13 of the folding flap cylinder 6. In the direction of rotation of the folding blade cylinder 3, following the belt roller 10 at a small distance from the jacket 15 of the folding blade cylinder 3, a suction chamber 16 is fastened between the press side frames. The belt roller 10 and the suction chamber 16 extend over the length of the cylinder.

Another aspect of the invention resides in that the suction chamber 16 is located on a guide plate 21 for the forward half of the copy 4, and has suction openings 22 over the length of the suction chamber 16.

Still another aspect of the invention resides in that the suction chamber 16 is divided over its length by partitions, and each segment 23 is separately equipped with adjustment apparatuses for the feed of suction air.

The invention as described hereinabove in the context of a preferred embodiment is not to be taken as limited to all of the provided details thereof, since modifications and variations thereof may be made without departing from the spirit and scope of the invention.

What is claimed is:

1. Apparatus for guiding and moving a copy segment through a portion of the folding apparatus of a rotary printing press which includes a rotatable folding blade cylinder which defines a longitudinal dimension and a rotatable folding flap cylinder having a generally cylindrical exterior surface, said apparatus comprising:

movable conveyor belt means for being relatively positioned with respect to the folding flap cylinder with at least a portion of said movable conveyor belt means for moving in conjunction with and for bearing upon a copy segment adjacent at least a portion of the exterior surface of the folding flap cylinder, with the folding blade cylinder and the folding flap cylinder being relatively positioned and provided to guide and move the copy segment to between said movable conveyor belt means and the folding flap cylinder by the rotation of the movable conveyor belt means in conjunction with the folding flap cylinder being provided to further move and guide the copy segment through a portion of the folding apparatus;

folding means for folding the copy segment;

suction means positioned for removing the copy segment from the folding blade cylinder;

said suction means comprising a plurality of generally individual segments; and means for adjusting suction in said individual segments.

2. The apparatus according to claim 1, wherein the copy segment is in removable contact with the folding blade cylinder as the copy segment moves through a portion of the folding apparatus.

3. The apparatus according to claim 2, said suction means being positioned adjacent the folding blade cylinder.

4. The apparatus according to claim 3, wherein said suction means extends along generally the entire longitudinal dimension of the folding blade cylinder.

5. The apparatus according to claim 3, wherein said folding means comprises a folding blade and folding flaps.

6. The apparatus according to claim 5, wherein said movable conveyor belt means and the folding flap cylinder assist in folding the copy segment as it moves through a portion of the folding apparatus.

7. The apparatus of claim 6, wherein said suction means further includes partition means for partitioning said suction means into said plurality of generally individual segments.

8. The apparatus of claim 7, wherein the amount of suction in each said individual segments may be independently adjusted.

9. The apparatus of claim 8, wherein the folding blade cylinder includes pin means for at least partially puncturing and placing the copy segment in said at least partial removable contact with the folding blade cylinder.

10. The apparatus of claim 9, wherein:

said folding means comprises a folding blade and folding flaps;

the folding blade cylinder has said folding blade disposed therein;

the folding flap cylinder has said folding flaps disposed therein; and said folding blade and said folding flaps cooperate to guide and move the copy segment to between said movable conveyor belt means and the folding flap cylinder.

11. The apparatus of claim 2, wherein the folding blade cylinder includes pin means for at least partially puncturing and placing the copy segment in said at least partial removable contact with the folding blade cylinder.

12. The apparatus of claim 11, wherein:

said folding means comprises a folding blade and folding flaps;

the folding blade cylinder has said folding blade disposed therein;

the folding flap cylinder has said folding flaps disposed therein; and said folding blade and said folding flaps cooperate to guide and move the copy segment to between said movable conveyor belt means and the folding flap cylinder.

13. The apparatus according to claim 1, said suction means comprising guide means for guiding the movement of at least a portion of the copy segment.

14. The apparatus according to claim 13, said guide means comprising ink-repellent plastic material.

15. The apparatus according to claim 1, said movable conveyor belt means comprising at least one belt roller and at least one belt means;

said at least one conveyor belt comprising means for driving said at least one belt roller.

16. Apparatus for guiding and moving a copy segment through a portion of a folding apparatus of a rotary printing press, wherein the folding apparatus includes a rotatable folding blade cylinder defining a longitudinal dimension and a rotatable folding flap cylinder having a generally cylindrical exterior surface, said apparatus comprising:

movable conveyor belt means comprising at least one belt roller and at least one belt means;

at least one of said belt means disposed about said at least one belt roller;

one of said at least one belt roller being disposed adjacent the folding flap cylinder and substantially adjacent the folding blade cylinder;

at least a portion of said belt means for moving in conjunction with and for bearing upon a copy segment adjacent at least a portion of the exterior surface of the folding flap cylinder;

suction means positioned adjacent the folding blade cylinder and also disposed from said folding flap cylinder, said suction means being for removing the copy segment from the folding blade cylinder;

said suction means being independent of said at least one belt roller; and said suction means and said one of said at least one belt roller extending along generally the entire longitudinal dimension of the folding blade cylinder.

* * * * *